US006379844B1

(12) United States Patent
Redey et al.

(10) Patent No.: US 6,379,844 B1
(45) Date of Patent: Apr. 30, 2002

(54) LOW RESISTANCE ELECTRODE CONSTRUCTION

(75) Inventors: Laszlo Redey, Downers Grove; Eric J. Karell, Woodridge, both of IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/487,825

(22) Filed: Jan. 20, 2000

(51) Int. Cl.[7] ..... H01M 4/36; H01M 4/40; H01M 4/29

(52) U.S. Cl. ..... 429/231.9; 429/102; 429/231.95; 429/231.5; 205/59; 205/62; 29/623.1

(58) Field of Search ..... 29/623.1; 429/231.9, 429/231.95, 231.5, 102; 205/59, 62; 204/292, 280

(56) References Cited

U.S. PATENT DOCUMENTS 3,847,667 A * 11/1974 Werth
3,877,984 A * 4/1975 Werth
4,452,777 A * 6/1984 Abraham et al. ..... 429/104
4,609,596 A * 9/1986 Hitchcock et al. ..... 429/104

* cited by examiner

*Primary Examiner*—Carol Chaney
*Assistant Examiner*—Tracy Dove
(74) *Attorney, Agent, or Firm*—Bradley W. Smith; Mark P. Dvorscak; Virginia B. Caress

(57) ABSTRACT

An electrochemical cell having a cathode and an anode in contact with an electrolyte. Both electrodes or one of them has an electrically conducting non-metal receptacle defining a chamber with a first metal having a melting point in the range of from about room temperature to about 800° C. inside said receptacle chamber. A second metal with a melting point greater than about 800° C. is in contact with the first metal inside the receptacle chamber and extends outside of the receptacle chamber to form a terminal for the anode. The electrolyte may include the oxides, halides or mixtures thereof of one or more of Li, V, U, Al and the lanthanides. Metal may be produced at the cathode during operation of the cell and oxygen or chlorine at the anode.

6 Claims, 4 Drawing Sheets

Schematics Of The Low–Resistance Electrode (LRE)

Schematics Of The Low–Resistance Electrode (LRE)

Current Density Distribution in the Solid Anode (SA) and the New Low-Resistance Anode (LRA) are shown. Rotational Symmetry is Represented.

LOW RESISTANCE ELECTRODE CONSTRUCTION

CONTRACTUAL ORIGIN OF THE INVENTION

The United States Government has rights in this invention pursuant to Contract No. DE-AC02-98CH10913 between the U.S. Department of Energy (DOE) and The University of Chicago representing Argonne National Laboratory.

BACKGROUND OF THE INVENTION

This invention relates to low-resistance electrode constructions of electrically conducting non-metal (ceramic, semiconductor, or carbon-based) electrodes that have metal current leads as terminals. This invention also relates to the electrochemical cells using the low-resistance electrodes in electrochemical technologies, particularly for producing metal such as Li, V, U, lanthanides, Al, and the like from the corresponding soluble metal oxide, or halide salt, which is known as electrowinning. The low-resistance electrode construction includes a stable, electrically conductive ceramic or graphite with a hollow interior filled at least in part with a metal which is liquid at the cell's operating temperature. The liquid metal provides reduced resistance connection between the electrode body and the metal current lead acting as a terminal contact resistance between the non-metal electrode body and metal current lead are reduced by the use of liquid metal. Moreover, adverse effects from the thermal cycling of the metal compression fittings between the metal current lead or terminal and the non metallic electrode are obviated, thus reducing the propensity of the electrodes to crack due to the differences in coefficients of expansion between the ceramic and metal. While the preferred electrodes hereafter disclosed used ceramics of $SnO_2$ doped with antimony and copper for lowered electrical resistance, and with tin as the liquid metal, it is believed that the invention applies broadly to other stable, electrically conductive ceramics such as $TiB_2$. In addition to tin, other metals may be used in the hollow interior to lower resistance between the ceramic and power source or mercury such as gallium or mercury for low-temperature applications and also Bi, Cd, Na and Li, as well as alloys thereof for higher temperature applications.

SUMMARY OF THE INVENTION

Broadly, the inventive low-resistance electrode for an electrochemical cell may be described as an electrically conductive ceramic or carbon shape with a hollow interior filled at least in part with a metal that is liquid at the cell's operating temperature. A critical feature of the inventive anode construction is the current pathway through a solid metal, a liquid metal, and non-metal electrical conductor. The ceramic receptacle may also be doped to improve its electrical conductivity.

Accordingly, it is an object of the invention to provide an electrode comprising, a non-metal electrically conducting receptacle defining a chamber, a first metal having a melting point in the range of from about room temperature to about 800° C. inside the receptacle chamber, and a second metal that is solid at the operating temperature of the electrochemical cell in contact with the first metal inside the receptacle chamber and extending outside of the receptacle chamber forming a terminal for the electrode.

Another object of the invention is to provide an electrochemical cell comprising a cathode and an anode in contact with an electrolyte, the anode having an electrically conducting non-metal receptacle defining a chamber, a first metal having a melting point in the range of from about room temperature to about 800° C. inside the receptacle chamber, and a second metal that is solid at the operating temperature of the electrochemical cell in contact with the first metal inside the receptacle chamber and extending outside of the receptacle chamber forming a terminal for the anode, the electrolyte including the oxides, halides or mixtures thereof of one or more of Li, V, U, Al and the lanthanides.

Yet another object of the invention is to provide a method of producing a metal or an alloy from the oxides or halides or mixtures of the oxides and halides of the metal or the alloy constituents, comprising operating an electrochemical cell having a cathode with a terminal and an anode with a terminal in contact with an electrolyte, the anode having an electrically conducting non-metal receptacle defining a chamber, a first metal having a melting point in the range of from about room temperature to about 800° C. inside the receptacle chamber, a second metal that is solid at the operating temperature of the electrochemical cell in contact with the first metal inside the receptacle chamber and extending outside of said receptacle chamber forming a terminal for the anode, the electrolyte including the oxides, halides or mixtures thereof of one or more of Li, V, U, Al and the lanthanides, and establishing a potential across the cathode terminal and anode terminal to cause metal oxides or halides of Li, V, U, Al and the lanthanides in the electrolyte to be reduced to the metal or an alloy at the cathode and for oxygen or other gas as appropriate to be evolved at the anode.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

The present invention together with the above and other objects and advantages may best be understood from the following detailed description of the embodiment of the invention illustrated in the drawings, wherein.

DESCRIPTION OF THE PREFERRED EMBODIMENT

Experiments with small, laboratory scale cells have identified several advantageous and disadvantageous properties of the $SnO_2$ anode in LiCl melt. This anode is chemically very stable in a LiCl melt containing lithium oxide (tested up to 3.1 wt % lithium oxide). Unlike the previously used platinum anode, the tin oxide anode is very stable at high anodic potentials. Neither the evolving oxygen, nor chlorine attacks this anode. Tin tetrachloride formation, at the theoretical possibility, as a result of a reaction between chlorine and tin oxide has not been detected in experiments dedicated to explore this issue. Based on these findings, we may consider this commercially available $SnO_2$ material an inert, stable oxygen-evolving anode.

A solid piece of tin-dioxide is a semiconductor ceramic material having a relatively high electrical resistance. Doping the $SnO_2$ with antimony and copper produces a material having relatively low electrical resistivity, although about three-four orders of magnitude higher than that of metals. Its resistivity has a large negative temperature coefficient. The resistivity at 650° C. has been measured 0.34 ohm cm in one experiment. Although tin oxide is a good inert anode, it is not a practical electrode in a solid rod form because of its high resistivity. By inert, we mean it has little chemical reactivity to its environment at cell operating temperatures. The high resistance results in high cell voltage, out of which the electrochemically useful part that produces oxygen is only about 25% at 3-A cell current. When the cell voltage is excessively high compared to the electrochemically useful part of the anode potential, the process control is very difficult.

Figure 1:
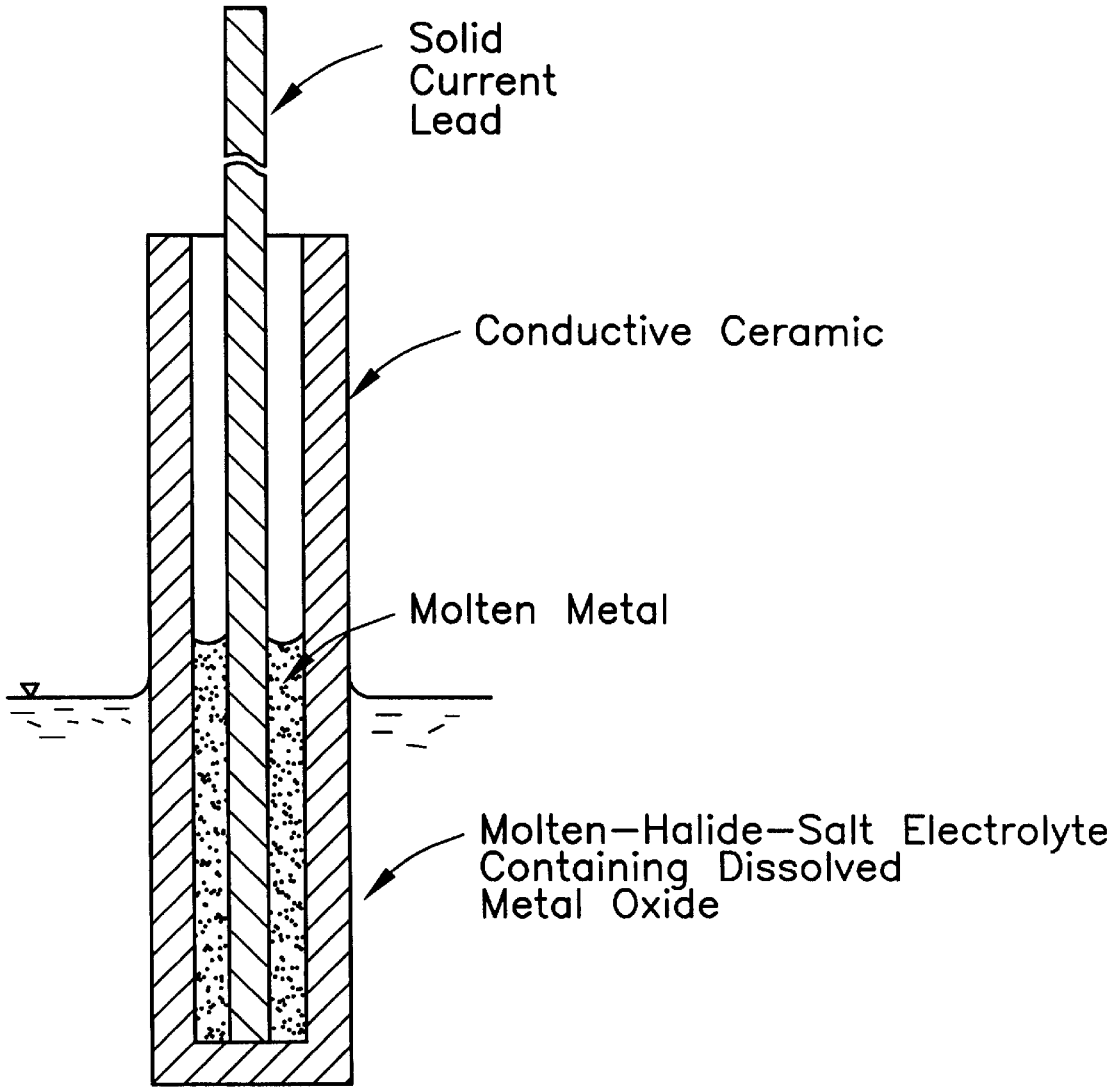
FIG. 1 is a schematic of a low resistance electrode (LRE) of the invention.

To reduce the problems associated with the high electrode resistance, a new electrode design has been discovered. The essence of the new design is illustrated in FIG. 1. Instead of a solid rod, the new electrode is a test tube-like structure. A molten metal provides excellent electrical contact inside the tube between the anode body and the metal current lead. The new design reduces the electrode resistance to less than a tenth of the original value as shown by Table 1. Table 1 and FIGS. 2, 3 and 4 refer to a particular low-resistance electrode made of a tin-oxide ceramic and serves as anode in an electrochemical cell.

TABLE 1

Typical resistance parameters of the 0.375-in. diameter, 15-cm long solid anode rods (SA) and the new Low-Resistance Anode (LRA)

| Anode design | Temperature ° C. | Specific resistance ohn/cm | Contact res. ohm | Total resistance ohm |
|---|---|---|---|---|
| SA | 25 | 1.79 | 12 | 38.8 |
| | 650 | 0.22 | 0.3 | 3.6 |
| LRA | 25 | NA | NA | 0.9 |
| | 650 | NA | NA | 0.2 |

The new anode is termed low-resistance tin-oxide anode. Table 1 shows typical resistance parameters of the 0.375-in diameter, 15-cm long solid anode rods (SA) and the new Low-Resistance Anode (LRA) at 650° C. and at room temperature.

Figure 2:
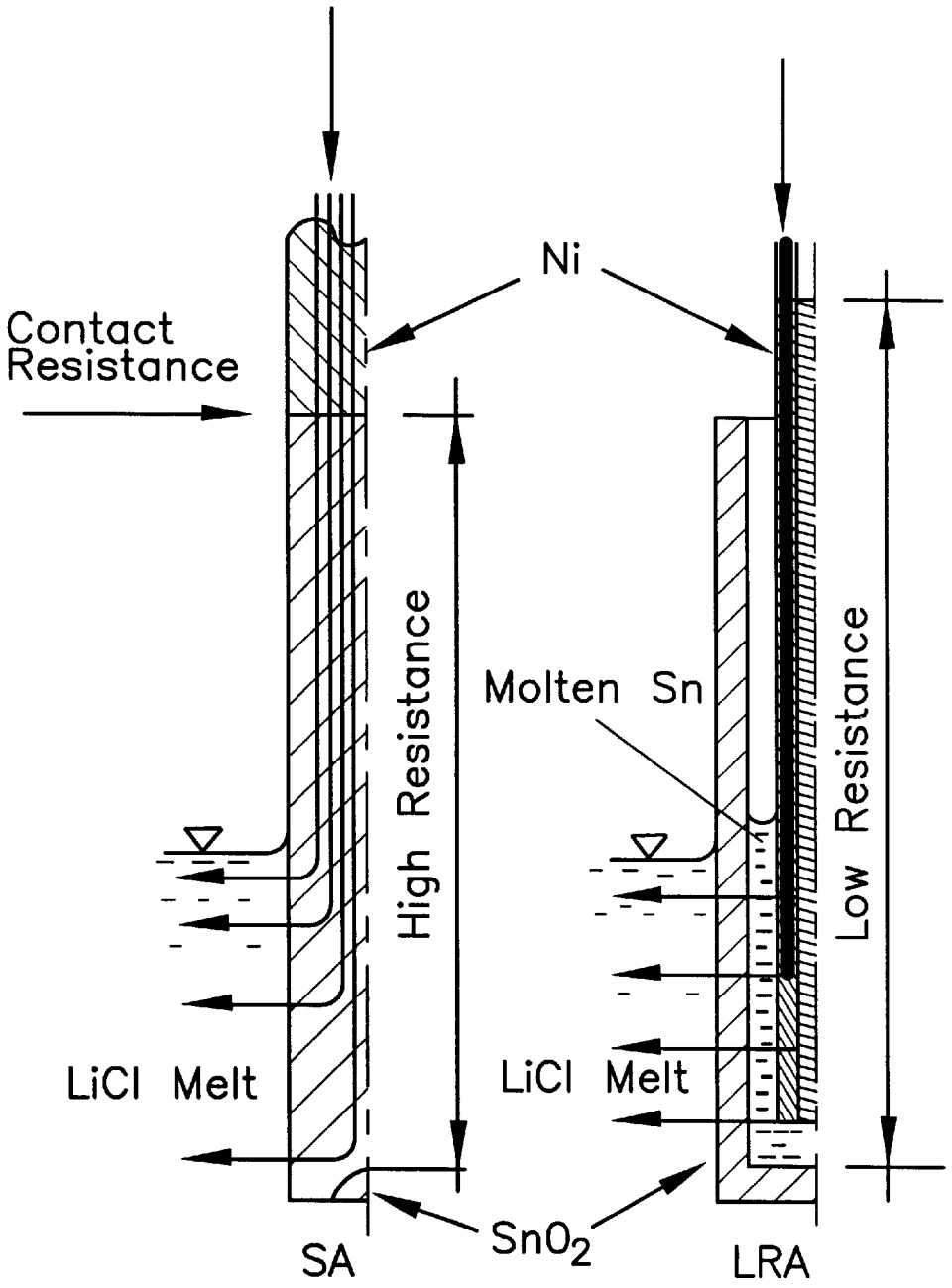
FIG. 2 is a schematic reproduction of current density distribution in a prior art high resistance and the inventive low resistance electrode.

The specific resistance and contact resistance are not applicable for the low resistance anode; see FIG. 2. The resistance of the LRA was measured after a week-long exposure of 650° C. and five thermal cycles between room temperature and 650° C.

Experiments show that molten tin as contact medium and nickel as current lead are satisfactory. After a week-long thermal test and several thermal cycles the electrode has shown good integrity. The new LRA design has several advantages compared to the previously used solid anodes. The intimate contact between the molten metal and the solid components completely eliminates the contact resistance problem and the need for a compressive metal-ceramic connection. The metallic current lead reaches down to the electrochemically active zone of the anode. Thus, the ceramic conducts current only in a very short distance through the wall of the tube. FIG. 2 shows the current distribution in the solid rod and the LRA design. Low anode resistance and uniform current density are achieved on the entire electrochemically working surface of the new anode. The tin-oxide wall of the tube acts as a chemically inert anode surface.

Figure 3:
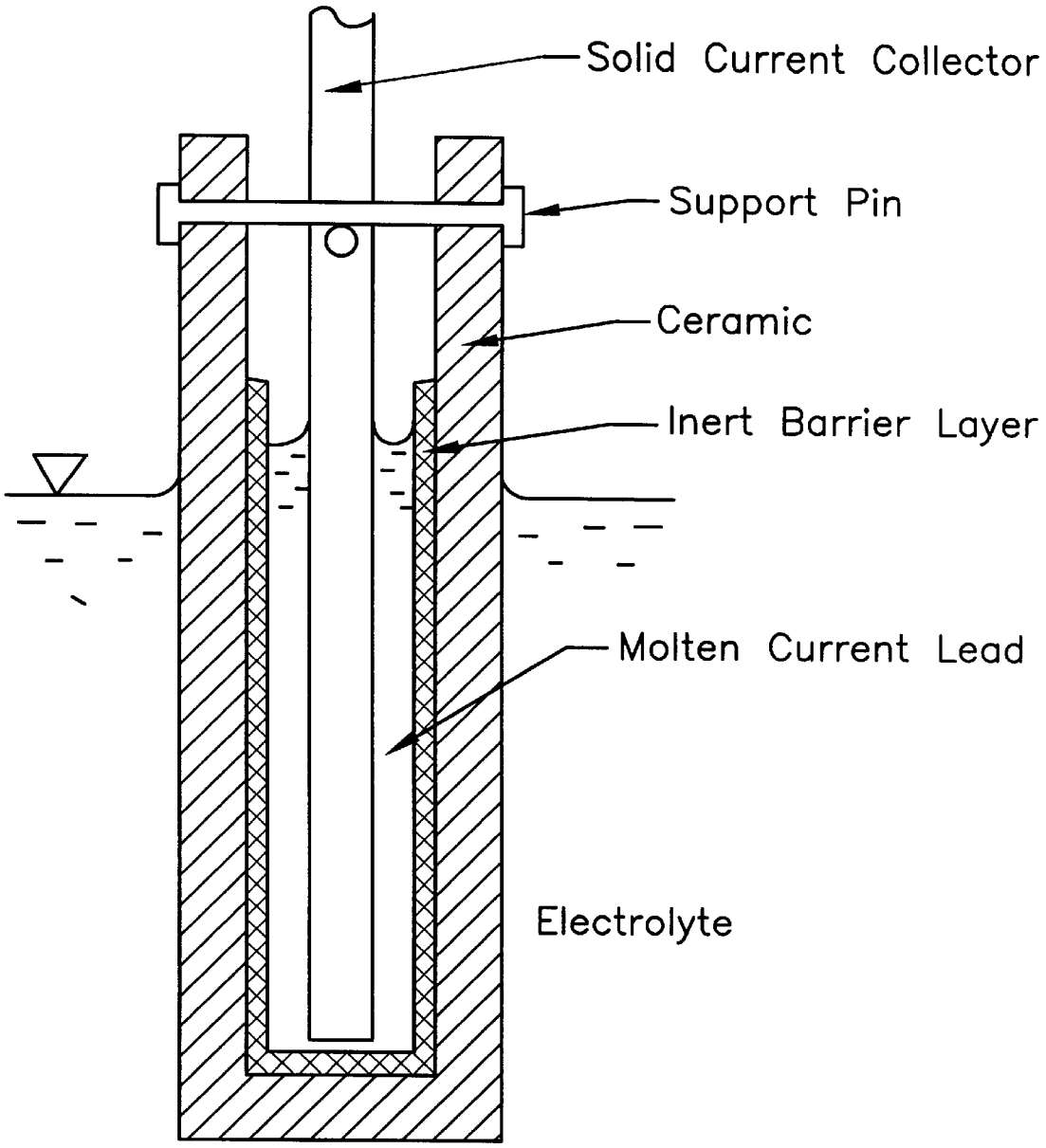
FIG. 3 is a schematic of another embodiment of a low resistance electrode.

Referring to FIG. 3, there is shown an alternate embodiment of the subject electrode in which a ceramic hollow structure or tube is provided with an inert barrier layer between the ceramic tube and the molten current lead inside the ceramic tube or configuration. A solid current collector is supported in the ceramic receptacle by a pin or other mechanism and is surrounded by the molten current metal.

It has been found in the previous tin oxide low resistance anode experiments, solid state ion migration tended to resolve the molten tin. The tin ions then electrochemically deposit in the liquid lithium cathode of the cell forming a lithium tin alloy. To prevent this adverse affect, a blocking electrobarrier for inside wall of the ceramic cavity has been provided. The barrier has to be both chemically and electrochemically inert to both the ceramic and molten metal. A particular barrier which was useful in the lithium oxide electrowinning experiments was a thin nickel barrier on the interior or inside wall of the cavity shown in FIG. 3. Nickel can be provided in a variety of ways, such as by electroless chemical deposition of a thin nickel layer of 5–50 microns thick or the electrochemical deposition of the nickel layer or a chemical vapor deposition or for that matter by sputtering. All of these methods are well known and acceptable means by which a electrochemical and chemically inert layer can be deposited on the inside of the ceramic receptacle.

It is important to point out that, although this describes in detail the use of the electrode only for oxygen evolving process, the same electrode construction is applicable for all ceramic—metal electrode combinations, especially for those that go through thermal cycles.

Generally, there has been disclosed a low resistance electrode (LRA) in which a non-metal electrically conducting receptacle defines a chamber in which a first metal, molten at cell operating temperatures, is positioned. Inside the first metal is a second metal which has a melting point greater than cell operating temperature usually greater than about 800° C. It should be noted that the first metal generally has a melting temperature in the area of about room temperature to about 800° C. although lower melting metals can also be used and preferably from about 200° to about 650° C. Representative materials for the receptacle are a wide variety of ceramics which are electrically conducting either by their nature or when doped with suitable materials such as $SnO_2$. In addition to the doped $SnO_2$ previously disclosed NiO is acceptable material as are certain iron oxides, particularly magnetite, $TiB_2$, $ZrB_2$ which are electrically conductive. Carbon-based graphite receptacles are also acceptable in this low resistance anode. The parameters required for the anode are that it be relatively chemically inert to the electrolyte melt, which for instance may be a variety of halides or oxides and that the anode receptacle material be relatively chemically inert to the molten metal inside the anode. By relatively chemically inert we mean that whatever chemical reactions occur between the electrolyte and the receptacle or between the molten metal and the receptacle they are not so extensive as to threaten the physical integrity of the electrode over prolonged thermal cycling and repeated uses. It is recognized that almost any material reacts to some minor degree so that it is probably improper to say absolutely that these preferred materials are chemically inert. What we mean is that to those of ordinary skill in this art, the preferred materials and acceptable materials are those which in use do not degrade to a point where the physical integrity of the electrode is threatened.

Representative metals useful in the present invention which are molten at cell operating temperatures are Sn, Ga, Bi, Cd, Hg, Na, Li and various alloys thereof. The terminal or second metal connected to the power source may be preferably one or more of Ni, Ta, Mo, W, Pt, Au, Ag and alloys thereof. Again, the principal requirement for the first metal is that it is relatively chemically and electrochemically inert with respect to the electrode container or non-metal receptacle previously described and relatively chemically inert with respect to the second metal or terminal lead. Moreover, the melting point of the first metal must be substantially less than the melting point of the terminal lead or second metal. The requirements for the second metal are obvious in view of what was said above, that is, the requirements for the second metal are that it is relatively chemically inert with respect to the first metal and that its melting temperature is in excess of the first metal and certainly in excess of cell operating temperatures.

Figure 4:
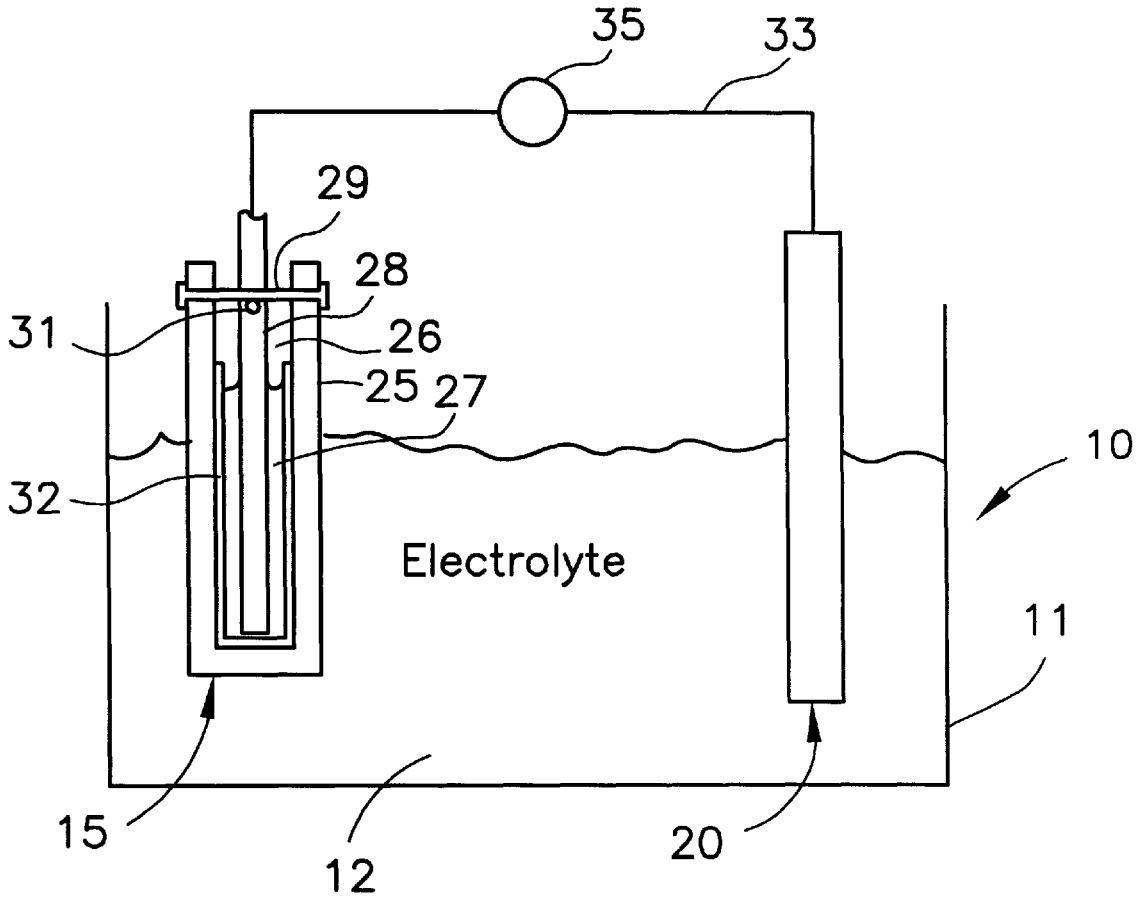
FIG. 4 is a schematic illustration of an electrochemical cell for electrowinning metals from their salts.

Referring to FIG. 4, there is disclosed a cell 10 having a cell housing 11 which holds an electrolyte 12, an anode 15 and a cathode 20. More particularly, the anode 15 includes a non-metal receptacle 25 which as previously described, may be made of any electrically conducting non-metal material which is generally chemically resistant to adverse chemical reactions with the electrolyte as well as the metal inside the anode 15, as will be described. The receptacle 25 defines a chamber 26 therein which receives a first metal 27 which has a melting point generally such that it becomes molten at cell operating temperature and generally non-chemically and electrochemically reactive as previously described, with respect to the receptacle 25 and the second metal 28 which extends into the first metal 27 housed in the cavity 26 and then outwardly of the anode 15 to act as a terminal for the anode. The second metal or terminal 28 is held in position by means of a simple pin 29 extending through the receptacle 25 and a protrudence 31 extending outwardly of the terminal 28 which cooperates with the second metal or terminal 28 to maintain the anode 15 in an upright position in the cell 10. A thin liner layer or liner 32 is attached to the inner wall of the receptacle 25 by chemical or electrochemical means. The liner 32 is made of metal that is chemically and electrochemically inert to the receptacle 25 and the molten metal 27. It should be noted, however, that a commercial embodiment could be very different in a specific structure, but will remain the same in general principal, it being within the skill of one of ordinary skill in the art to design the specifics of holding the terminal 28 with respect to the anode receptacle 25 and also to maintain the anode 15 in an upright position in the cell 10.

The cathode 20 may be of any cathodic material, such as porous stainless steel and the cathode 20 is connected to the anode 15 by means of suitable electrical conductors 33 and to a source of power 35 so that a voltage potential can be established across the cathode and the anode. When a potential is established across the cathode and anode, metal ions in the electrolyte tend to be reduced and to drop out of the electrolyte as metal at the cathode and oxygen or chlorine is evolved at the anode. More particularly, when the electrolyte is selected from the oxides, halides or mixtures thereof of one or more of Li, V, U, Al as well as the lanthanides and various mixtures thereof, then the corresponding metals are produced at the cathode and the oxygen or chlorine is evolved as previously discussed at the anode. Alloys can be made simply by providing a suitable mix of the corresponding halide or oxide salt in the electrolyte melt.

As can be seen from the above described cell 10, cell operating temperature has to be sufficient so as to provide the electrolyte and molten or liquid condition as well as the first metal 27 should be molten so as to provide a superior electrical characteristics of the improved low resistance anode 15.

While there has been disclosed what is considered to be the preferred embodiment of the present intention, it is understood that various changes in the details may be made without departing from the spirit, or sacrificing any of the advantages of the present invention.

The embodiments of the invention in which an exclusive property or privilegs is claimed are defined as follows:

1. An electrode for use in an electrochemical cell having an electrolyte which is subject to a limited operating temperature comprising; a vessel, constructed of an electrically conductive ceramic oxide wherein said ceramic oxide is selected from $SnO_2$ doped with Sb and Cu, NiO and electron-conducting iron oxides and has an outer surface and an inner chamber which serve to define a wall thickness of said vessel and where said outer surface of said vessel is in contact with the electrolyte when said vessel is immersed in the electrolyte and said inner chamber is physically isolated from said electrolyte by said wall thickness, a first electrically conducting metal having a melting point in the range of from about room temperature to about 800° C. where said melting point is below the operating temperature of said electrolyte and where said first electrically conducting metal is positioned in said vessel chamber and is in electrical contact with said vessel, and a second electrically conducting metal having a melting point greater than the operating temperature of the electrolyte of the electrochemical cell and where said second metal is positioned relative to said first metal such that it is in electrical contact with said first metal and extends outside of said vessel chamber to form an external terminal for the electrode.

2. An electrode for use in an electrochemical cell having an electrolyte which is subject to a limited operating temperature comprising; a vessel, constructed of an electrically conductive ceramic wherein the ceramic is electron-conducting $SnO_2$ or $TiB_2$ and has an outer surface and an inner chamber which serve to define a wall thickness of said vessel and where said outer surface of said vessel is in contact with the electrolyte when said vessel is immersed in the electrolyte and said inner chamber is physically isolated from said electrolyte by said wall thickness, a first electrically conducting metal having a melting point in the range of from about room temperature to about 800° C. where said melting point is below the operating temperature of said electrolyte and where said first electrically conducting metal is positioned in said vessel chamber and is in electrical contact with said vessel, and a second electrically conducting metal having a melting point greater than the operating temperature of the electrolyte of the electrochemical cell and where said second metal is positioned relative to said first metal such that it is in electrical contact with said first metal and extends outside of said vessel chamber to form an external terminal for the electrode.

3. An electrode for use in an electrochemical cell having an electrolyte which is subject to a limited operating temperature comprising; a vessel, constructed of a non-metal, predominantly graphite, electrically conducting material having an outer surface and an inner chamber which serve to define a wall thickness of said vessel and where said outer surface of said vessel is in contact with the electrolyte when said vessel is immersed in the electrolyte and said inner chamber is physically isolated from said electrolyte by said wall thickness, a first electrically conducting metal having a melting point in the range of from about room temperature to about 800° C. where said melting point is below the operating temperature of said electrolyte and where said first electrically conducting metal is positioned in said vessel chamber and is in electrical contact with said vessel, and a second electrically conducting metal having a melting point greater than the operating temperature of the electrolyte of the electrochemical cell and where said second metal is positioned relative to said first metal such that it is in electrical contact with said first metal and extends outside of said vessel chamber to form an external terminal for the electrode.

4. An electrochemical cell comprising a cathode and an anode in contact with an electrolyte herein the electrochemical cell has an operating temperature and where, said anode is comprised of an electrically conducting ceramic oxide vessel of $SnO_2$ doped with Sb and Cu and serves as the anode and has an outer wall and an inner chamber where said outer wall is in contact with said electrolyte, a first electrically conducting metal having a melting point in the range of from about room temperature to about 800° C. which is below the operating temperature of said electrochemical cell and where said first metal is positioned inside said vessel chamber and is in electrical contact with said vessel, and a second electrically conducting metal having a melting point greater than the operating temperature of the electrochemical cell and where said second metal is in electrical contact with said first metal and extends outside of said vessel chamber to form an external terminal for said anode, and where said electrolyte is selected from the group comprising the oxides, halides or mixtures thereof of one or more of Li, V, U, Al and the lanthanides.

5. An electrochemical cell comprising a cathode and an anode in contact with an electrolyte herein the electrochemical cell has an operating temperature and where, said anode is comprised of an electrically conducting ceramic vessel comprised of electron-conducting $SiO_2$ or $TiB_2$ or NiO or electron-conducting iron oxides and has an outer wall and an inner chamber where said outer wall is in contact with said electrolyte, a first electrically conducting metal having a melting point in the range of from about room temperature to about 800° C. which is below the operating temperature of said electrochemical cell and where said first metal is positioned inside said vessel chamber and is in electrical contact with said vessel, and a second electrically conducting metal having a melting point greater than the operating temperature of the electrochemical cell and where said second metal is in electrical contact with said first metal and extends outside of said vessel chamber to form an external terminal for said anode, and where said electrolyte is selected from the group comprising the oxides, halides or mixtures thereof of one or more of Li, V, U, Al and the lanthanides.

6. An electrochemical cell comprising a cathode of porous stainless steel and an anode in contact with an electrolyte herein the electrochemical cell has an operating temperature and where, said anode is comprised of an electrically conducting non-metal vessel having an outer wall and an inner chamber where said outer wall is in contact with said electrolyte, a first electrically conducting metal which is selected from a group comprising Sn, Ga, Bi, Cd, Na, Li, and alloys thereof and having a melting point in the range of from about room temperature to about 800° C. which is below the operating temperature of said electrochemical cell and where said first metal is positioned inside said vessel chamber and is in electrical contact with said vessel, and a second electrically conducting metal which is selected from the group comprising Ni, Ta, W, Pt, Au, Ag and alloys thereof and having a melting point greater than the operating temperature of the electrochemical cell and where said second metal is in electrical contact with said first metal and extends outside of said vessel chamber to form an external terminal for said anode, and where said electrolyte is selected from the group comprising the oxides, halides or mixtures thereof of one or more of Li, V, U, Al and the lanthanides.

* * * * *